United States Patent [19]

Hopkins

[11] Patent Number: 4,607,465

[45] Date of Patent: Aug. 26, 1986

[54] LEAF EXCLUDER FOR RAIN WATER GUTTERING

[76] Inventor: Graham K. Hopkins, 1a Cobran Road, Cheltenham, New South Wales 2119, Australia

[21] Appl. No.: 690,322

[22] Filed: Jan. 8, 1985

[51] Int. Cl.[4] ..... E04D 13/00

[52] U.S. Cl. ..... 52/12; 210/474

[58] Field of Search ..... 52/11, 12; 210/473, 210/474

[56] References Cited

U.S. PATENT DOCUMENTS

| | | | |
|---|---|---|---|
| 870,165 | 11/1907 | Hager et al. | 210/474 |
| 1,243,119 | 10/1917 | Wicks | 52/12 |
| 2,271,081 | 1/1942 | Layton | 52/12 |
| 3,053,393 | 9/1962 | McLean | 52/12 X |
| 3,864,267 | 2/1975 | Nelems | 52/12 X |

FOREIGN PATENT DOCUMENTS

| | | | |
|---|---|---|---|
| 267697 | 6/1964 | Australia | 52/12 |
| 1509127 | 8/1969 | Fed. Rep. of Germany | 52/12 |

*Primary Examiner*—William F. Pate, III
*Assistant Examiner*—Creighton Smith
*Attorney, Agent, or Firm*—Anthony A. O'Brien

[57] ABSTRACT

A leaf excluder for a rain water guttering of channel form having one outer upper free edge terminating in a curled bead. The leaf excluder comprises a strip of flexible resilient sheet-like material with a plurality of bead engaging fingers along and projecting from one edge and a plurality of water passing slots in the strip at an angle to the length dimension of the strip. The width of the strip between opposite edges is such that with the fingers engaged with a guttering bead and the opposite edge of the excluder engaged in the diagonally opposite corner of the guttering the body of the excluder will be upwardly arched to cause the slotted part of the excluder to bear against the terminal end of roof cladding which overlaps the inner upper free edge of the guttering.

5 Claims, 7 Drawing Figures

LEAF EXCLUDER FOR RAIN WATER GUTTERING

This invention relates to leaf excluders for rain water gutterings.

Most gutterings can be classified as channel type gutterings having a rear wall, a bottom and a front wall. A common form of guttering of the channel type is called "quad" guttering and it has at the upper edge of the front wall an inwardly curled bead for the purpose of decoration of the upper front edge of the guttering and to avoid a sharp and dangerous edge on the guttering. Whilst this invention has not been designed for use exclusively with quad guttering it is particularly suited for use therewith.

Broadly, the present invention can be said to provide a leaf excluder for a rain water guttering of channel form having a rear wall with a lower edge joined to a guttering bottom to provide a rear corner of the guttering, and a front wall joined to the guttering bottom and having a free edge terminating in a curled bead; said leaf excluder comprising a strip of flexible resilient sheet-like material with a plurality of bead engaging fingers along and projecting from one edge and a plurality of water passing slots in the strip at an angle to the length dimension of the strip, the width of said strip between the said one edge and the opposite edge of said strip exceeding the spacing apart of the guttering rear corner and that portion of the bead proximal thereto.

Figure 1:
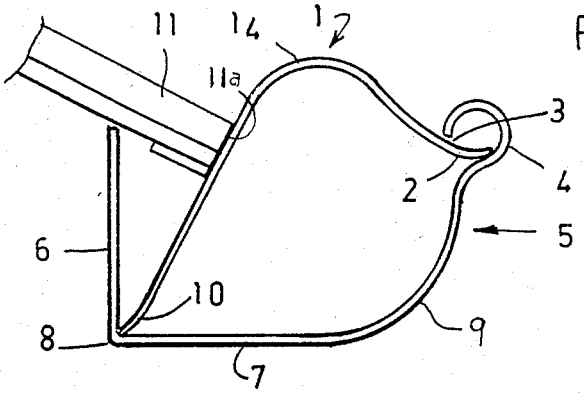
Figure 2:
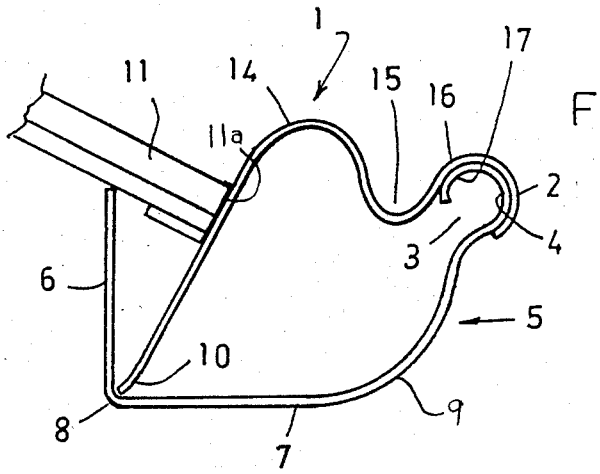
Figure 3:
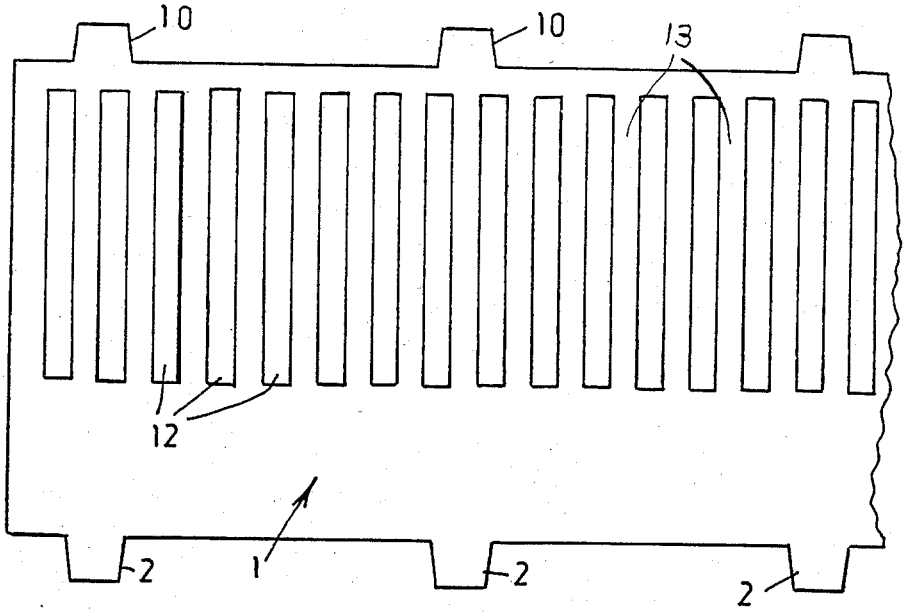
Figure 4:
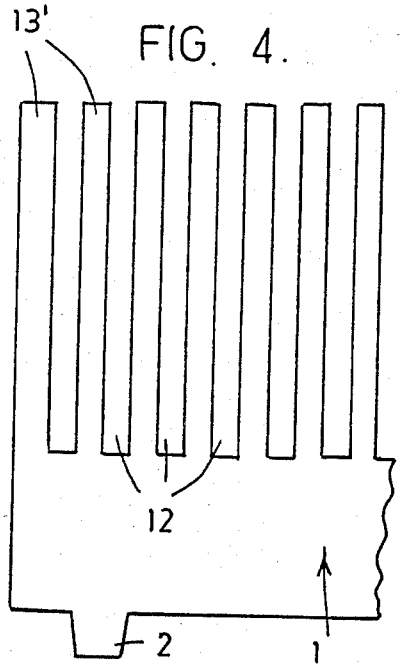
Figure 5:
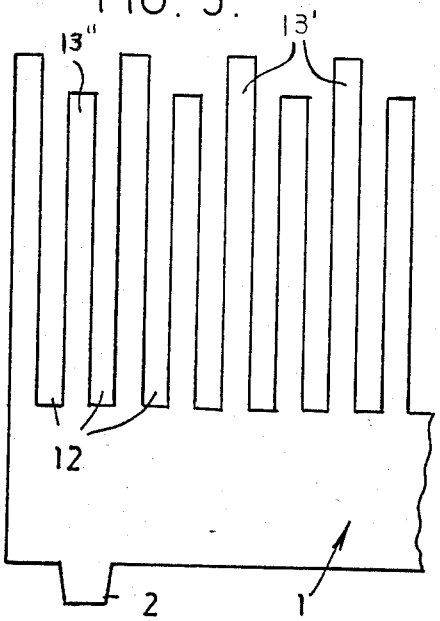
Figure 6:
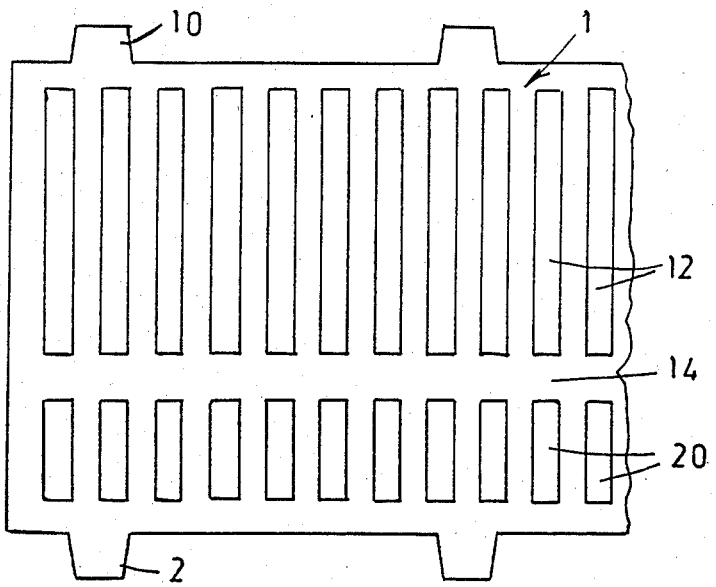
Figure 7:
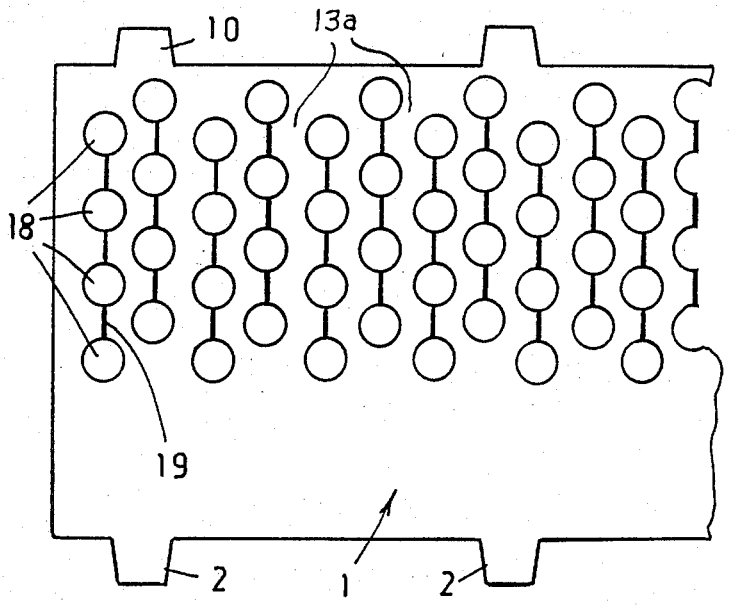

Several presently preferred embodiments of the invention will now be described with reference to the accompanying drawings in which:

FIG. 1 is an end view of a first embodiment of the invention mounted in a quad guttering, FIG. 2 is an end view of a second embodiment of the invention mounted in a quad guttering, FIG. 3 is a plan view of a short length of leaf excluder as shown in FIG. 1, FIG. 4 is a plan view of a portion of a length of leaf excluder showing a different arrangement of slots to those shown FIG. 3, FIG. 5 is a view similar to FIG. 4 showing another arrangement of slots, FIG. 6 is a view similar to FIG. 3 showing yet another arrangement of slots and FIG. 7 is a view similar to FIG. 3 showing yet another arrangement of slots.

As illustrated in FIGS. 1 and 3 the leaf excluder has a body part 1 made from a sheet material which is flexible and resilient, for example a UV resistant plastics sheet material. It is to be understood however that other materials can be used for the leaf excluders to be now described, for example sheet metal could be used. Along one edge of the body 1 there are fingers 2 adapted to engage in the gap 3 where the bead curl 4 of the quad guttering 5 is incomplete. The quad guttering comprises a rear wall 6 joined to a bottom 7 to form a rear corner 8 for the guttering. The guttering front wall 9 is curved and is an extension of the guttering bottom 7 and terminates in the inwardly curled bead 4. In this way the fingers 2 lock one edge of the leaf excluder body 1 in position on the guttering.

Along the opposite edge of the body 1 there are fingers 10 to engage in the rear corner 8 of the guttering. It will be noted that the distance between the ends of the fingers 10 and the edge of the leaf excluder body 1 from which the fingers 2 extend is greater than the direct distance between the rear corner 8 of the guttering and the proximal portion of the bead 4. It follows that in order to mount the leaf excluder in the guttering it must be bowed upwardly, as shown in FIG. 1. It will be noted that in FIG. 1 the terminal edge or end 11*a* of a roof tile or like roof cladding 11 is illustrated and that the body of the leaf excluder abuts the end 11*a* of the roof tile. It is essential that this tile to excluder engagement takes place in order to form a barrier to prevent leaves passing between the end of the tile 11 and the body of the leaf excluder and forming a pocket of debris which could result in the corrosion of the guttering.

From FIG. 3 it will be seen that along the body 1 of the leaf excluder there are water admitting openings or slots 12 and that the strips or bands 13 between the slots 12 provide barriers to the entry of leaves into the guttering whilst water can freely enter though the slots 12.

It will be seen that any leaves that are swept down onto the leaf excluder will, because of the smooth flowing form of the leaf excluder when in its bent installed form, pass up onto or over the crest 14 of the bent leaf excluder. After rain the leaves which have not passed over the crest 14 due to their momentum on being swept down onto the leaf excluder with rain water running off the roof tiles 11 will rest there to dry out and will subsequently be blown away by the wind.

The embodiment of FIG. 2 is similar to that of FIGS. 1 and 3 except that the fingers 2 are elongated and are curled and adapted to engage around the exterior of the curl 4 and in order to promote the upward curvature of the body 1 there is a valley 15 formed in the body 1 to provide a shoulder 16 to bear against the inner edge 17 of the curl 4.

FIG. 4 illustrates an arrangement where the slots 12 extend right to the edge of the body 1 and the strips 13' comprise the fingers whose ends engage in the rear corner 8 of the guttering. It will be understood that this arangement is the equivalent of the embodiments of FIGS. 1 and 2 with the fingers 10 omitted, which is another possible embodiment of the invention. FIG. 5 is a variation of the FIG. 4 arrangement where some of the strips 13' are longer than their adjacent strips 13 to provide spaced fingers for engagement in the rear corner of the guttering.

FIG. 7 shows an arrangement where the slots 12 are comprised of chains of holes 18 connected by slits 19 so to as to provide the individually flexible strips 13*a* which engage with the ends of the tile 11.

FIG. 6 shows an arrangement which is a development of the slots of the FIG. 3 arrangement including additional slots 20 to the front of the crest zone 14 of the body.

It will be understood that the slots 12 can be at angles to the length direction of the leaf excluder body and that in the case of the FIG. 6 arrangement the slots to either side of the crest zone 14 can be at different and even oppositely directed angles.

The fingers 2 and/or 10 are preferably long enough to allow for trimming so that the fingers of a leaf excluder made for the largest anticipated size guttering can be shortened to allow the leaf excluder to be mounted in a smaller section guttering.

The fingers 2 are desirable for a number of reasons. For example, they are easier to manipulate than a straight edge when the entry into or wrapping around a bead is undertaken. With the FIG. 1 arrangement water will not be trapped in the bead—which could occur if a straight edge was provided—because it can pass through the gaps between the fingers 2 into the guttering where is can drain away. The fingers 2 facilitate the installation operation by avoiding the guttering bracket legs that are curled over the outer surface of the guttering bead. If the fingers 2 were not provided there would be interference between the bead engaging edge of the leaf excluder and the guttering bracket legs. Such interference can be avoided with the proposed fingers 2 by simply cutting off any finger 2 which would otherwise overlap or be aligned with a guttering bracket leg.

It will be understood that the body strip 1 of plastics material can be made with an initial curvature to predispose the body to curve at the zone 14. This could be done as a subsequent operation to one in which a parallel strip of plastics material is passed through a tool where the material between the fingers 2 and 10 and the material from the slots 12 is removed. For example the punched strip could be passed over a heated member or through a heated chamber where the zone 14 is heated to the point where the plastics material becomes soft enough to bend. The bent strip would then be passed through a cooling area where the bend in the plastics material is "set" as a result of reducing the temperature of the strip. The valley 15 of the strip shown in FIG. 2 could be formed in the same way by passing a longitudnal heated portion of the strip through a forming tool and then cooling the formed strip.

In other arrangements the bead engaging fingers can be prepared with a small upward curvature to facilitate entry into a bead, see the FIG. 1 arrangement, and are preferably formed with a curled configuration to facilitate installation as shown in FIG. 2.

I claim:

1. A leaf excluder for a rain water guttering of channel for having a rear wall with a lower edge joined to a guttering bottom to provide a rear corner of the guttering and a front wall joined to the guttering bottom and having a free edge terminating in a curled bead and which when in use will have the ends of tiles or like roof cladding overlapping the guttering rear wall so as to deposit rain water over and forward of said guttering rear wall; and leaf excluder comprising a strip of flexible resilient sheet-like material with a plurality of bead engaging fingers along and projecting from a one edge and a plurality of water passing slots in the strip at an angle to the length dimension of the strip; the width of said strip as defined between the said one edge and an opposite edge of said strip exceeding the distance between said guttering rear corner and that portion of the bead proximal thereto by an amount such that when the leaf excluder is located in a gutting with said bead engaging fingers engaging said bead and said opposite edge engaged in said rear corner of said guttering there will be an upwardly bent barrier portion of said strip extending at least as high as the top of said roof cladding ends and presenting a face incorporating said slots, said face being disposed substantially at right angles to and in abutting relationship with said ends of the roof cladding over the length of said guttering.

2. A leaf excluder as claimed in claim 1 wherein said slots are substantially transverse to the length direction of the strip and extend from the opposite edge of said strip to provide bands between said slots, and at least some of said bands comprising said fingers along said opposite edge of said strip.

3. A leaf excluder as claimed in claim 1 wherein said bead in inwardly curled toward said bottom and defines a gap therein, and said bead engaging fingers adapted to engage in said gap.

4. A leaf excluder as claimed in claim 1 wherein said bead engaging fingers are adapted to exteriorly wrap around said curled bead.

5. A leaf excluder as claimed in claim 4 wherein said strip includes a longitudinal valley adjacent to said one strip edge, the side of said valley adjacent said one strip edge being adapted to abut said bead free edge.

* * * * *